United States Patent [19]

Smit

[11] Patent Number: 4,515,427

[45] Date of Patent: May 7, 1985

[54] COAXIAL CABLE WITH A CONNECTOR

[75] Inventor: Hermanus Smit, Eindhoven, Netherlands

[73] Assignee: U.S. Philips Corporation, New York, N.Y.

[21] Appl. No.: 454,408

[22] Filed: Dec. 29, 1982

[30] Foreign Application Priority Data

Jan. 6, 1982 [NL] Netherlands ..... 8200018

[51] Int. Cl.[3] ..... H01R 17/18

[52] U.S. Cl. ..... 339/177 E; 339/276 R; 339/218 M

[58] Field of Search ..... 339/177, 89 C, 90 C; 29/828

[56] References Cited

U.S. PATENT DOCUMENTS

| | | | |
|---|---|---|---|
| 2,678,963 | 5/1954 | Everheart | 339/177 R |
| 2,736,872 | 2/1956 | Heath et al. | 339/177 E |
| 3,104,145 | 9/1963 | Somerset | 339/177 R |
| 3,110,756 | 11/1963 | Genung et al. | 339/177 R |
| 3,171,707 | 3/1965 | Powell | 339/177 R |
| 3,404,363 | 10/1968 | Fischer | 339/94 M |
| 3,517,375 | 6/1970 | Mancini | 339/177 R |
| 4,053,200 | 10/1977 | Pugner | 339/177 R |
| 4,368,576 | 1/1983 | Smit | 29/828 |
| 4,420,210 | 12/1983 | Karol et al. | 339/94 M |

FOREIGN PATENT DOCUMENTS 1346884 2/1974 United Kingdom .

*Primary Examiner*—Gil Weidenfeld
*Assistant Examiner*—David L. Pirlot
*Attorney, Agent, or Firm*—David R. Treacy

[57] ABSTRACT

Coaxial cable (1) with a connector which comprises a central contact (23) connected to the central conductor (3) and a sheath contact (11) connected to the conducting sheath (7). An end portion of the conducting sheath is axially flattened to form a disk and is clamped between a transverse wall (15) of the sheath contact (11), which wall is provided at the center with a passage (17), and a sleeve (19) which is bent inwards at its edge and is arranged coaxially with the transverse wall. As a result, the operation of mounting the connector can be mechanized very simply and readily.

6 Claims, 2 Drawing Figures

COAXIAL CABLE WITH A CONNECTOR

BACKGROUND OF THE INVENTION

The invention relates to a coaxial cable with a central conductor which is surrounded by an intermediate insulating layer and a conducting sheath, which cable is provided at least at one of its ends with a connector which comprises a central contact connected to the central conductor and a tubular sheath contact connected to the conducting sheath.

The connector may be, for example, a coaxial plug, in which event the central contact can be constructed as a pin contact or as a socket. Such a combination of a coaxial cable with a plug is known, for example, from British Patent Specification No. 1,346,884. The sheath contact of the known plug comprises a number of resilient fingers which engage the conducting sheath of the cable at a location where any outer insulating layer has been removed. The fingers are urged against the sheath by wedge-shaped pressure elements in cooperation with a clamping ring. Due to the large number of component parts involved, this plug is comparatively expensive and the operation of mounting the plug on the cable is complicated and time-consuming. Moreover, the fingers do not constitute a continuous closed conductor, as a result of which it is possible that the seal for high-frequency electromagnetic radiation does not satisfy all the relevant requirements.

SUMMARY OF THE INVENTION

The object of the invention is to provide a coaxial cable with a connector of the aforementioned kind, which can be mounted in a very simple and, if desired, mechanized manner and offers the possibility of establishing a continuous d.c. connection between the sheath contact and the conducting sheath of the cable.

The coaxial cable according to the invention is therefore characterized in that an end portion of the conducting sheath, which end portion is flattened by axial compression into the form of a disk, is clamped between a transverse wall of the sheath contact, which wall extends in a plane substantially at right angles to the axis of the cable and is provided at the center with a passage, and a sleeve which is bent inwards at its edge and is coaxial with the transverse wall.

The sheath contact with the sleeve constitutes a single one-piece unitary (that is, all one piece) component part, while the operation of bending the sleeve inwards at its edge can be very readily mechanized. If the end portion of the conducting sheath of the coaxial cable is freed from any outer insulating layer on the sheath before mounting the sheath contact, the sleeve has a continuous d.c. connection with the sheath. If such a continuous connection is not particularly important, the outer insulating layer may remain intact, if desired, and may be only locally perforated, for example, by teeth provided on the sleeve or on the transverse wall, which are then d.c. connected with the conducting sheath at a plurality of points around the periphery.

A preferred embodiment of the coaxial cable according to the invention is characterized in that the passage at the center of the transverse wall of the sheath contact has a diameter lying between the outer diameter of the intermediate insulating layer and the outer diameter of the conducting sheath. When the end portion of the cable is inserted into the passage, the intermediate insulating layer slides into the passage but the conducting sheath is compressed in the axial direction to form a disk which can then be clamped against the transverse wall by bending over the edge of the sleeve.

A further preferred embodiment of the coaxial cable according to the invention is characterized in that the region in which the cable is connected to the central contact and to the sheath contact is surrounded by a body molded from synthetic resin. The process of injection-molding the body around the contacts is inexpensive and can readily be mechanized.

The invention will be described more fully with reference to the drawings.

DESCRIPTION OF THE PREFERRED EMBODIMENTS

Figure 1:
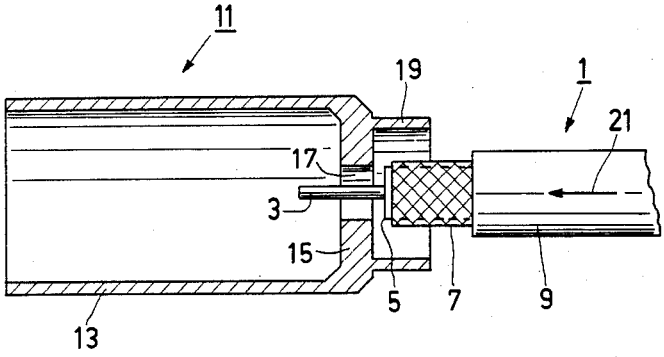
FIG. 1 is a longitudinal sectional view of an embodiment of a sheath contact and coaxial cable according to the invention during mounting of the contact on the cable.

The coaxial cable 1 shown in FIG. 1 comprises a central conductor 3, an intermediate insulating layer 5 and a conducting sheath 7 surrounded by an outer insulating layer 9. The central conductor 3 consists of, for example, a single wire or of a bundle of wires, and the conducting sheath 7 can consist of a flexible structure of thin twisted wires. The insulating layers 5 and 9 consist of a synthetic resin.

Over the left-hand end portion of the cable 1, as seen in FIG. 1, the outer insulating layer 9 is removed so that the conducting sheath 7 is exposed, and over a terminal part of this end portion of the cable the conducting sheath 7 and the intermediate insulating layer 5 also are removed so that the central conductor 3 is exposed.

Figure 2:
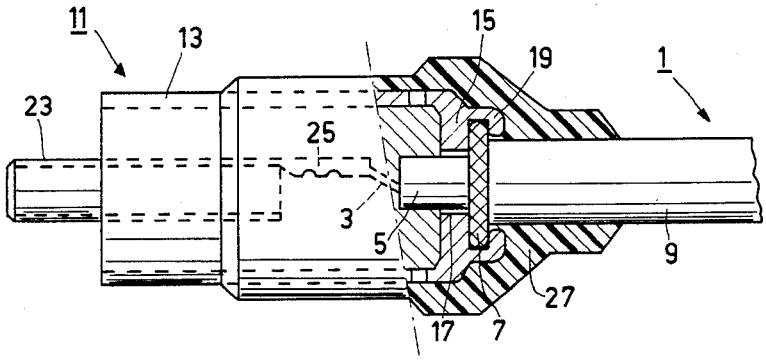
FIG. 2 is a side elevation (partly in cross-section) of an embodiment of a coaxial cable according to the invention with the sheath contact shown in FIG. 1 after termination of the mounting operation.

The conducting sheath 7 is connected electrically and mechanically to a sheath contact 11 which is mainly constituted by a tubular socket 13. For electrical and mechanical connection, the sheath contact 11 has a transverse wall 15 which extends from an inner peripheral surface of the tubular socket and is provided at its center with a passage 17 and on which is formed a coaxially projecting sleeve 19 having an edge remote from the wall 15. The end portion of the cable 1 is inserted, during mounting of the sheath contact, into the passage 17 in the direction of the arrow 21, the axis of the cable being directed substantially at right angles to a substantially planar wall surface of the transverse wall 15. The diameter of the passage 17 preferably lies between the outer diameter of the intermediate insulating layer 5 and the outer diameter of the conducting sheath 7 so that during the insertion of the cable the end portion of the conducting sheath is stopped by the wall 15 and is compressed in the axial direction. This end portion then expands in the radial direction so that it ultimately assumes the form of a disk, as is illustrated in FIG. 2. This disk lies within the sleeve 19, which is then bent inwards at its edge so that the end portion of the conducting sheath 7 is clamped on all sides between the wall 15 and the sleeve 19.

If desired, the end portion of the conducting sheath 7 may alternatively be flattened into the form of a disk by a separate tool before the cable 1 is inserted into the passage 17, in which case, the diameter of this passage may slightly exceed the outer diameter of the conducting sheath 7.

It is also possible to compress an end portion of the conducting sheath 7 in the axial direction so as to form a disk using a method similar to that described in the Netherlands patent application no. 7908378 to which U.S. Pat. No. 4,368,576 corresponds. In case the outer insulating layer 9 is cut through circumferentially to free an end portion of this layer, which end portion is then slid along the conducting sheath 7, shortened and finally moved back. It is possible to remove the intermediate insulating layer 5 as far back as the proximity of the disk obtained by the axial compression of the conducting sheath 7. In that case, after the outer insulating layer 9 has been removed from the end portion of the cable, the preliminary removal of the conducting sheath 7 and the intermediate insulating layer 5 over a terminal part of this end portion is, of course, not necessary. The diameter of the passage 17 may then, if desired, be so small that the central conductor 3 can just pass through it, in which case it may be desirable to provide an insulating layer on the wall of the passage.

After insertion of the end portion of the cable 1 into the sheath contact 11, the central conductor 3 is connected electrically and mechanically to a central contact 23, which may consist of a socket or a pin. In the embodiment shown in FIG. 2, the central contact 23 is a pin contact formed from sheet material and provided at the right-hand end (as viewed in FIG. 2) with a connection part 25 which is crimped onto the central conductor 3. Other methods of securing the central contact 23, such as, for example, soldering, are of course also possible. If the diameter of the passage 17 exceeds that of the central contact 23, the central contact can be secured to the central conductor 3 before the cable is inserted into the sheath contact 11.

When the cable has been inserted into the sheath contact 11 and the central conductor 3 has been connected to the central contact 23, the region in which the cable 1 is connected to the contacts 11 and 23 is surrounded by 1 body 27 of synthetic resin formed by molding. The body 27 ensures that the connector can be handled freely and that the central contact 23, the sheath contact 11 and the cable 1 are fixed relative to one another.

The coaxial cable with connector shown in FIGS. 1 and 2 is only one of the possible embodiments of the device according to the invention. Besides the modifications already mentioned in the above description, many further modifications are possible. For example, the sheath contact 11 may be constructed as a pin contact. Its form may then be substantially identical to that of the sheath contact shown but its orientation in the axial direction relative to the cable is reversed with respect to the orientation shown in FIGS. 1 and 2 before it is slid onto the cable 1. The tubular contact 13 then encloses the cable 1 and acts as a pin contact. The sleeve 19 is then located on the inside of the sheath contact and in this case the passage 17 must be sufficiently large to allow the conducting sheath 7 also to pass through it. This sheath is then flattened to form a disk after the sheath contact has been slid onto the cable.

The wall of the tubular contact 13 may be provided, if desired, with axial incisions in order to form flexible contact fingers.

What is claimed is:

1. A coaxial cable having a connector permanently attached at one end, comprising a central cable conductor defining a cable axis, an intermediate insulating layer surrounding said conductor, a conducting cable sheath having an end portion of the sheath formed by axial compression into a transverse disk, a sheath contact electrically connected to said sheath end portion, and a central contact electrically connected to said central conductor, characterized in that said sheath contact consists of a one-piece unitary article comprising a transverse wall having at least one substantially planar surface, a coaxial sleeve extending in a first direction from said substantially planar surface and having an edge portion remote from said surface, and a socket portion extending coaxially in the direction opposite said first direction, said transverse wall extends upwardly from an inner peripheral surface of said socket portion and forms a common wall between the socket portion and the coaxial sleeve, said transverse wall has a passage therethrough, at least said central conductor passing through said passage, said transverse disk extends parallel to said substantially planar surface, interiorly of said sleeve, and said sleeve edge portion is bent inwards to clamp said disc against said surface so as to establish electrical and mechanical connection between the conducting sheath and the sheath contact.

2. A cable as claimed in claim 1, characterized by comprising a body of synthetic resin material molded directly around and surrounding said sleeve and a portion of said socket portion.

3. A cable as claimed in claim 1, characterized in that said passage has a diameter at least equal to the outside diameter of said intermediate insulating layer, and in that said layer extends at least into said passage.

4. A cable as claimed in claim 3, characterized by comprising a body of synthetic resin material molded directly around and surrounding said sleeve and a portion of said socket portion.

5. A coaxial cable having a connector permanently attached at one end, comprising a central cable conductor defining a cable axis, an intermediate insulating layer surrounding said conductor, a conducting cable sheath having an end portion of the sheath formed by axial compression into a transverse disk, a sheath contact electrically connected to said sheath end portion, and a central contact electrically connected to said central conductor, characterized in that said sheath contact consists of a unitary article comprising a transverse wall having at least one substantially planar surface, a coaxial sleeve extending in a first direction from said substantially planar surface and having an edge portion remote from said surface, and a socket portion extending coaxially in the direction opposite said first direction, said transverse wall has a passage therethrough, having a diameter at least equal to the outside diameter of said intermediate insulating layer but less than the outside diameter of said conducting sheath, said intermediate insulating layer extending at least into said passage, and said central conductor passing through said passage, said transverse disk abuts said substantially planar surface, interiorly of said sleeve, and said sleeve edge portion is bent inwards to clamp said disc directly against said substantially planar surface, thereby establishing permanent electrical and mechanical connection between the disk and the sheath contact on both sides of the disk.

6. A cable as claimed in claim 5, characterized by comprising a body of synthetic resin material molded directly around and surrounding said sleeve and a portion of said socket portion.

* * * * *

UNITED STATES PATENT AND TRADEMARK OFFICE

CERTIFICATE OF CORRECTION

PATENT NO. : 4,515,427

DATED : May 7, 1985

INVENTOR(S) : HERMANUS SMIT

It is certified that error appears in the above-identified patent and that said Letters Patent is hereby corrected as shown below:

Claim 1, (Col. 4) line 21, Change "upwardly" to --inwardly--

Signed and Sealed this

*Twenty-seventh* Day of *August 1985*

[SEAL]

*Attest:*

DONALD J. QUIGG

*Attesting Officer* *Acting Commissioner of Patents and Trademarks*